US006666093B2

(12) United States Patent
Morganti

(10) Patent No.: US 6,666,093 B2
(45) Date of Patent: Dec. 23, 2003

(54) SYSTEM FOR REMOTE DIAGNOSIS OF THE STATE OF WEAR OF THE SUCTION AND DELIVERY VALVES OF RECIPROCATING COMPRESSORS

(75) Inventor: Piero Morganti, Prato (IT)

(73) Assignee: Nuovo Pignone Holding S.p.A., Florence (IT)

( * ) Notice: Subject to any disclaimer, the term of this patent is extended or adjusted under 35 U.S.C. 154(b) by 145 days.

(21) Appl. No.: 09/935,336

(22) Filed: Aug. 23, 2001

(65) Prior Publication Data

US 2002/0023495 A1 Feb. 28, 2002

(30) Foreign Application Priority Data

Aug. 31, 2000 (IT) ..... MI2000A1932

(51) Int. Cl.[7] ..... G01N 29/14

(52) U.S. Cl. ..... 73/587; 73/659; 73/660; 702/34; 702/56

(58) Field of Search ..... 73/587, 659, 660; 702/183, 166, 185, 34, 33, 35, 56

(56) References Cited

U.S. PATENT DOCUMENTS 3,783,680 A * 1/1974 Mason ..... 340/683
4,429,578 A * 2/1984 Darrel et al. ..... 340/680
4,559,828 A * 12/1985 Liszka ..... 340/870.28
4,922,423 A * 5/1990 Koomey et al. ..... 702/39
4,980,844 A * 12/1990 Demjanenko et al. ..... 340/680
5,602,757 A * 2/1997 Haseley et al. ..... 340/635
5,610,339 A * 3/1997 Haseley et al. ..... 702/56
5,845,230 A * 12/1998 Lamberson ..... 340/683
6,026,348 A * 2/2000 Hala ..... 702/126
6,260,004 B1 * 7/2001 Hays et al. ..... 702/130
2003/0019297 A1 * 1/2003 Fiebelkorn et al. ..... 73/587

FOREIGN PATENT DOCUMENTS

DE 199 47 129 A1 * 4/2001 ..... F16K/37/00

* cited by examiner

*Primary Examiner*—Hezron Williams
*Assistant Examiner*—Rose M. Miller
(74) *Attorney, Agent, or Firm*—Nixon & Vanderhye

(57) ABSTRACT

A system for remote diagnosis of the state of wear of the suction and delivery valves of reciprocating compressors comprises at least one piezoelectric seismic sensor, applied to each cylinder of the compressor. The sensor transforms the vibrations generated by the noise of the valves into an electric signal. By appropriate amplification and filtering, the envelope of the resulting narrow band signal is obtained. The signal obtained is then digitized, and transmitted to a remote diagnostics center for monitoring.

9 Claims, 3 Drawing Sheets

Figure 1:
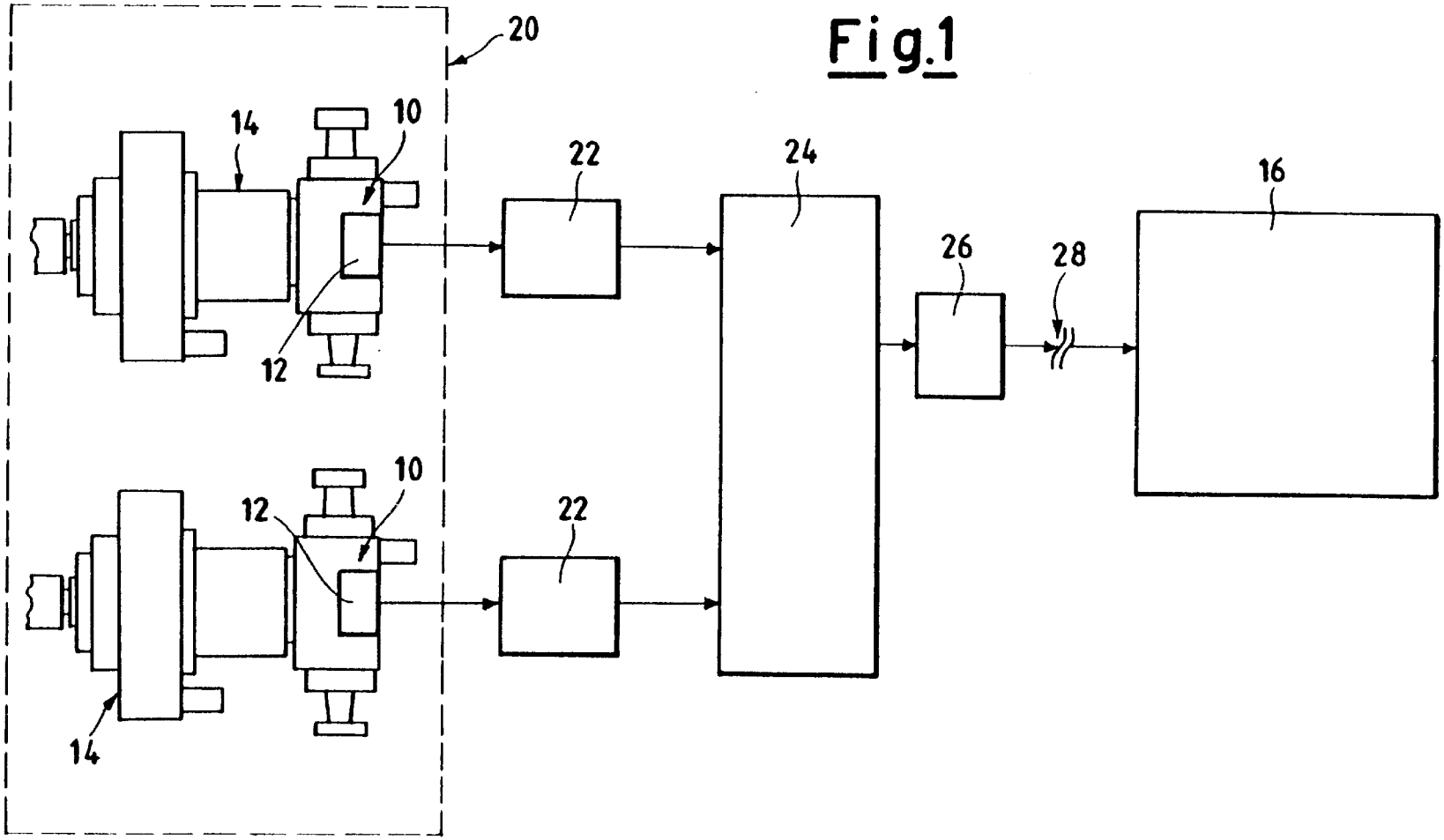

SYSTEM FOR REMOTE DIAGNOSIS OF THE STATE OF WEAR OF THE SUCTION AND DELIVERY VALVES OF RECIPROCATING COMPRESSORS

The present invention relates to a system for diagnosis of the state of wear of the delivery and suction valves of reciprocating compressors.

As is known, the term reciprocating volumetric compressors is used to indicate the thermal operating machines in which energy is transmitted by means of compressible fluids, substantially by varying their specific volume.

The variations of volume and the corresponding variations of pressure are obtained by the effect of the decrease of volume of the operating chamber of the machine, whereas the final variations are determined by the pressure conditions upstream and downstream from the operating machine itself.

In particular, the reciprocating compressors function with variations of volume of an operating chamber, which are obtained by straight displacement of a rigid body along the generatrices of a cylindrical cavity, and can be controlled by means of a crank mechanism, which permits transformation of motion from continuous circular, such as that which is generally supplied by electric and thermal motors, to reciprocating, as required in the specific case.

Like other reciprocating machines, for implementation of the different phases of the work cycle, the compressors of this type require an appropriate system of distribution, which is implemented almost exclusively by means of valves of two types: those of which the opening and closure is controlled, by means of a more or less complex kinematic chain, by the crankshaft of the compressor (controlled valves), and valves of the automatic type, which on the other hand are activated directly by the pressure differences between the interior and the exterior of the operating chamber.

At present, most compressors have automatic valves produced using different solutions, which are substantially derived from plate or cap valves.

Sealing is assured by the contact of various strips on a plate, which acts as a valve seat, and which contains numerous slits; the various strips are subjected to the action of return springs, which facilitate the closure and damp the opening.

In all cases, it is necessary to assure that the worn valves are replaced in time, since malfunctioning of the valves leads to decreases in the cross-sections of passage, and thus to reduced flow rates, with consequent unacceptable losses of load, which change the ideal work cycle into a significantly disadvantageous real cycle.

However, at present, replacement of the valves takes place after programmed maintenance has been carried out, i.e. when it is not yet strictly necessary, or after the valves have broken, resulting in undesirable stoppage of the compressor.

The disadvantages caused are apparent in both cases; in fact, these interventions give rise to interruption of production, whether the machine is stopped even if it is not necessary, or if the stoppage is unforeseen, owing to sudden breakage of one or more valves, or if the stoppage is longer than planned, because of any repairs of further components of the machine damaged by breakage of the valve(s).

As previously stated, the state of wear of a valve is indicated by various parameters, such as a decrease in delivery pressure, decrease in flow rate, increase in the temperature of the valve body, and noisiness of the valve in the field of audible frequencies.

Thus, by monitoring the undesirable variation of these parameters at each valve, it is possible to determine a valve which is malfunctioning, and to intervene mechanically in order to control the actual state of wear of that valve.

In all cases, periodic inspections of the state of wear are involved, which require stoppage of the compressor, with the same disadvantages as those previously described.

Alternatively, in order to evaluate the state of the valves during normal functioning of the compressor, it is known to make use of the phenomenon according to which the valves emit sound waves when they recirculate part of the compressed gas, after they have become worn.

In fact, the valves of the cylinders, both for suction and delivery, can undergo breakages of the rings, or they can function incorrectly owing to the presence of dirt or solid substances between the rings themselves and the corresponding stop seat.

In all these cases, there are conditions of reflux of the gas, which, as it heats up during the compression phase, gives rise to an increase in the temperature of the valve itself, the corresponding valve caps, and the body of the cylinder.

The progressive and physiological deterioration of the sealing surfaces, which come into contact between the valve and its seat, generate a phenomenon of recirculation of the gas, between the high-pressure side and the low-pressure side of the compressor, as a result of the irregularities which form on these surfaces over a period of time.

The recirculation of gas is caused by numerous small jets of gas, which escape through the irregularities of the contact surfaces, and give rise to emission of sound or ultrasound; measurement of this emission therefore provides an index of evaluation concerning the state of wear of the surfaces.

The object of the present invention is thus to indicate a system for diagnosis of the state of wear of the suction and delivery valves of reciprocating compressors, which makes it possible to monitor remotely the sound emissions produced by the malfunctioning valves, such as to be able to warn the operator during use, of the real need to stop the machine for maintenance on the valves.

This object and others according to the invention are achieved by a system for remote diagnosis of the state of wear of the suction and delivery valves of reciprocating compressors.

According to preferred, but non-limiting embodiments of the invention, in addition, the system for diagnosis uses a piezoelectric seismic sensor applied to each cylinder of the compressor at the valve to be monitored, which transforms the vibrations generated by the noise of the valves into a high-frequency electric signal, to be transmitted to a signal-amplifier device.

In addition, the electronic processing and control means comprise a signal-filtering device, which operates in the ultrasonic field of sound emission of the valves, an envelope detector, which determines the envelope of the input signal, with a resulting signal with a pass-band of 30 kHz, and a multiplexer for transmission of the data on a communication channel, such as a telephone line, a radio bridge, or satellite, or Internet/Intranet network. Advantageously, the system for diagnosis of the state of wear of the suction and delivery valves of reciprocating compressors according to the present invention, makes it possible to monitor remotely, from a remote seat, the sound emission produced by the valves in conditions of malfunctioning and imminent breakage of the latter, such as to warn the operator at the machine of the real need to stop the machine for maintenance or complete replacement of the valves.

By this means, it is no longer necessary for the operator to undertake periodic or planned stoppages of the compressor, or emergency interventions in order to repair any breakages of the valves; on the contrary, in the case of abnormalities of a valve, it is possible to detect and locate the occurrence of the degenerative phenomenon in good time.

In addition, the system for diagnosis which is the subject of the invention makes it possible to inform the operator of the machine accurately of the particular cylinder of the compressor which requires intervention, for maintenance on the valves.

Taking into consideration the fact that a reciprocating compressor may contain up to 12 cylinders with radial or axial valves, this possibility is extremely advantageous, since it prevents an entire series of dismantling operations, which would prove to be unnecessary once the malfunctioning valve(s) had been located.

Finally, the evaluation of the increase in noise over a period of time is an indication of the residual life of the valve, and makes it possible to stop the machine, for replacement of the valve, only when it is actually necessary.

Figure 2:
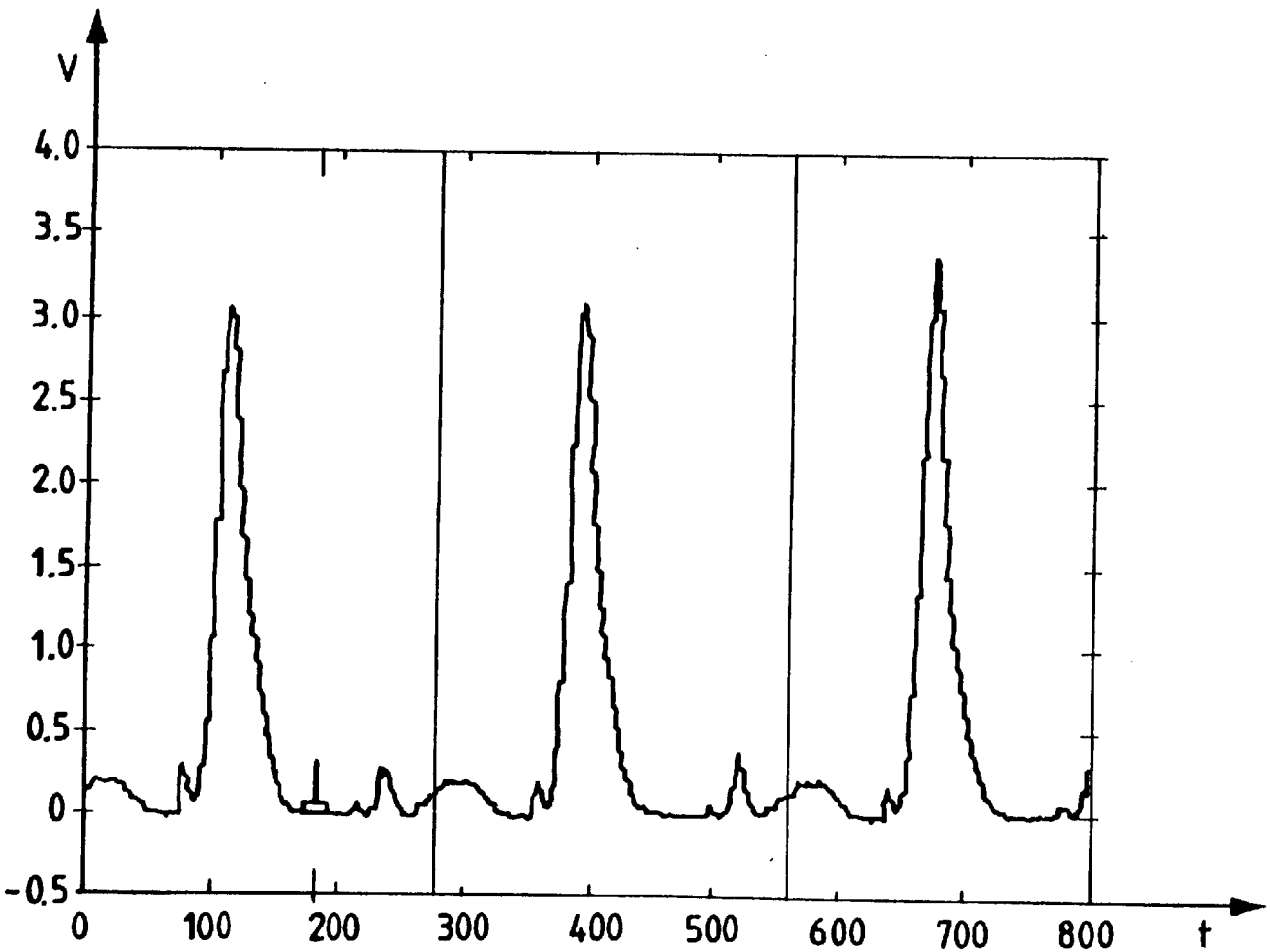
Figure 3:
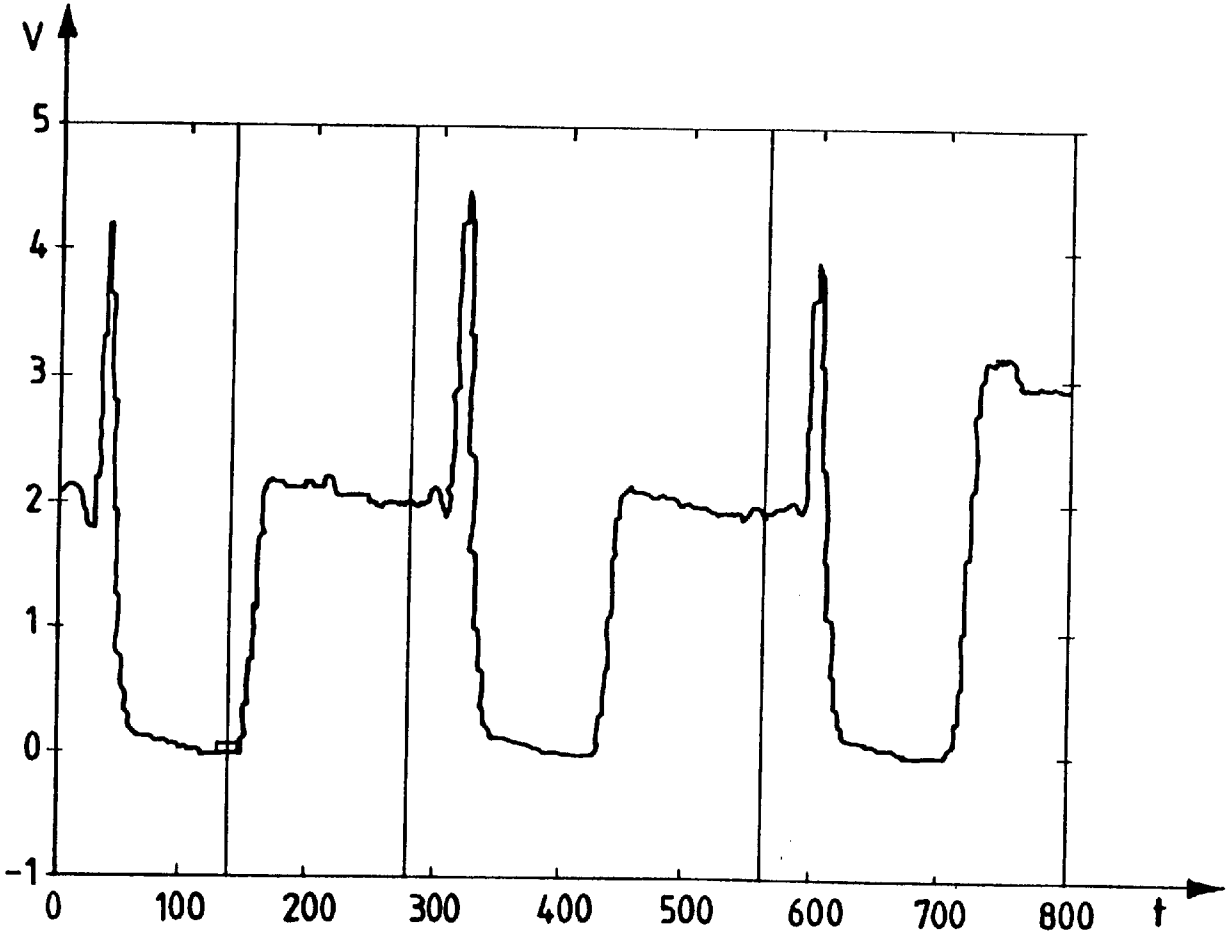

The characteristics and advantages of the system according to the present invention, for diagnosis of the state of wear of the suction and delivery valves of reciprocating compressors, will become more apparent from the following description of a typical embodiment, provided by way of non-limiting example, with reference to the attached schematic drawings, in which:

FIG. 1 represents a block diagram of the system according to the present invention, for remote diagnosis of the state of wear of the suction and delivery valves of reciprocating compressors, in which cylinders with radial valves are schematised generically; in this respect, it should be noted that the present invention can also be applied to cylinders of reciprocal compressors which have axial valves;

FIG. 2 is a cartesian graph, which represents the envelope of a signal obtained from a sensor applied to a cylinder of the reciprocating compressor according to FIG. 1, in conditions of considerable wear of the valve; and FIG. 3 is a Cartesian graph, which represents the envelope of a signal obtained from a sensor applied to a cylinder of the reciprocating compressor according to FIG. 1, in conditions of negligible wear of the valve. With reference to the aforementioned figures, 14 indicates schematically a cylinder, which can be respectively of the type with radial valves or axial valves, of a reciprocating compressor 20, and 12 indicates piezoelectric sensors, each of which is positioned on the vertical outer surface 10 of the head of the cylinder 14, close to the corresponding suction or delivery valve.

22 indicates amplifier devices, each of which is connected closely and locally to the corresponding piezoelectric sensor 12, whereas 24 indicates a block for measurement of the signals output by the amplifiers 22, comprising a multiplexer, an envelope measurer, and an electronic data acquisition system; these devices are usually installed in a suitable control area provided in the vicinity of the compressor 20.

Within the same area, there is also installed a modem 26, the input of which receives the signal output by the block 24.

The signal processed by the modem 26 is then transmitted on a telephone line 28, in order to be transmitted to a remote diagnostics centre 16.

Each piezoelectric seismic sensor 12 applied to each cylinder 14 of the reciprocating compressor 20 transforms the vibrations generated by the noise of the valves, in conditions of malfunctioning of the latter, into an electric signal, with frequencies which can be as much as 1000 kHz.

After amplification of the signal, which is obtained by means of the local amplifier 22, connected to each sensor 12, the same signal is filtered in a frequency band of 700–1000 kHz (ultrasonic field of noise of the valve), and the envelope is determined in the block 24 with a resulting signal, with a pass-band of 30 kHz.

The multiplexer in the block 24 permits digitisation of the signal, and thus, the latter is transmitted, via the modem 26 or another appropriate transmission means (radio bridge, satellite, Internet/Intranet network or the like), to a corresponding remote diagnostics centre 16.

On the basis of the amplitude of the wave form of the signal of the envelope received, an operator of the remote diagnostics centre 16, supported by an automatic alarm system, of a known type, can warn the operator of the compressor 20 of the need to carry out maintenance on one or a plurality of valves, when the noise in the ultrasonic field exceeds predetermined amplitude values.

By this means, the remote diagnostics centre 16 prevents the machine operators from having to establish exactly the times for periodic checks of the valves, or from having to carry out emergency repairs as a result of sudden breakages of the valves.

FIGS. 2 and 3 indicate respectively the envelopes of two signals obtained from a piezoelectric seismic sensor 12, applied to a cylinder 14 of a reciprocating compressor 20.

In particular, the graph in FIG. 2 represents an envelope of a signal obtained from a sensor 12 applied to a cylinder 14, in which there is no appreciable wear of the valve; in fact, the average value in Volts, in the time t, of the amplitude of signal V, minus the peaks, which are caused purely by phenomena of mechanical friction, is very low.

On the other hand, the Cartesian graph in FIG. 3 denotes strong wear, which requires maintenance of the valve, since the average signal value V in the time t is extremely high.

In practice, on the basis of the wave form of the signals received, the remote diagnostic centre 16 transmits a communication remotely to the machine operator, thus managing maintenance of the valves in the times required, and at the correct moment.

This communication is carried out on the basis of display of the signals on a series of monitors of the remote monitoring centre 16; the monitors carry out the functions of display of the signals measured by all the piezoelectric seismic sensors, or of the maximum signal measured (as an average value), of alarm and stoppage, and of supply of the sensors on the machine.

The signals which are obtained from the valves with the same effect, and which carry out the same function, are compared continuously on the monitors of the diagnostics centre 16, which generates an alarm if one of the signals detected diverges from the average value of the signals normally considered.

By this means, malfunctioning of one valve, compared with the other suction or pressure valves for other effects of the cylinders 14 which have the same compression phase, is brought immediately to the attention of the machine operator.

The description provided makes apparent the characteristics and advantages of the system according to the present invention, for remote diagnosis of the state of wear of the suction and delivery valves of reciprocating compressors.

In particular, these are represented by the following:

remote monitoring of the noise produced by the valves of the reciprocating compressors, so as to warn the machine operator of the real need to stop the machine for maintenance;

programmed periodic stoppages of the machine, or emergency interventions to repair any breakages of the valves, are not necessary; and accurate information concerning the cylinder on is which action must be taken in order to carry out maintenance on the valves, thus avoiding unnecessary dismantling.

Finally, it is apparent that many other variations can be made to the system which is the subject of the present invention, for remote diagnosis of the state of wear of the suction and delivery valves of reciprocating compressors, without departing from the principles of novelty which are inherent in the inventive concept.

It is apparent that, in the practical embodiment of the invention, any materials, dimensions and forms can be used according to requirements, and can be replaced by others which are technically equivalent.

The scope of the present invention is defined by the attached claims.

What is claimed is:

1. A system for remote diagnosis of the state of wear of suction and delivery valves of a reciprocating compressor based on use of sounding emissions emitted by the valves and which valves, upon wearing, recirculate part of gas compressed by the compressor, comprising:

at least one sensor positioned on a cylinder forming part of said reciprocating compressor for generating an electrical signal in response to the sound emissions of said valves;

an amplifier for amplifying the electrical signal;

an electronic processing and control means affording an electronic indication of the state of wear of the valves; and a remote diagnostic and monitoring system connected to said electronic processing and control means for remotely diagnosing the state of wear of the valves.

2. A system according to claim 1 wherein the remote diagnostic and monitoring system monitors the sound emissions of the valves remotely to warn an operator of the need to stop the compressor and carry out maintenance of said valves.

3. A system according to claim 1 wherein said sensor comprises a seismic sensor positioned on an external surface of a head of said cylinder adjacent a corresponding valve to be monitored.

4. A system according to claim 1 wherein said electronic processing and control means includes at least one filter for filtering the electrical signal, an envelope detector for generating a second electrical signal and a converter for digitizing the second electrical signal from said envelope detector.

5. A system according to claim 4 wherein said filter operates in the ultrasonic frequency field of the sound emissions from the valves.

6. A system according to claim 4 wherein said envelope detector determines an envelope of the electrical signal input to the detector with a resulting signal having a pass-band of 30 kHz.

7. A system according to claim 1 wherein transmission of said electrical signal from said electronic processing and control means to said remote diagnostic and monitoring system includes at least one modem and at least one of a telephone line, a radial bridge, a satellite and an Internet/Intranet network.

8. A system according to claim 1 wherein said sensor and said amplifier are installed on said cylinder of the compressor, said electronic processing and control means being installed adjacent the compressor and being interconnected to one another and to a data acquisition system.

9. A system according to claim 1 wherein said electronic processing and control means includes an envelope detector for receiving said electrical signal, together with means for establishing an average value of the amplitude of the wave form of the envelope signal, minus mechanical friction peaks and comparing the average value of the amplitude with an established amplitude value to warn of the need to carry out maintenance on said one valve of said compressor should emissions of the one valve exceed the established amplitude value.

* * * * *

UNITED STATES PATENT AND TRADEMARK OFFICE

CERTIFICATE OF CORRECTION

PATENT NO. : 6,666,093 B2
DATED : December 23, 2003
INVENTOR(S) : Morganti

It is certified that error appears in the above-identified patent and that said Letters Patent is hereby corrected as shown below:

Column 5,
Line 4, between "on" and "which", please delete -- is --.

Signed and Sealed this

Third Day of February, 2004

JON W. DUDAS
*Acting Director of the United States Patent and Trademark Office*